United States Patent [19]

Takemoto

[11] Patent Number: 4,974,021

[45] Date of Patent: Nov. 27, 1990

[54] DISCHARGING DEVICE FOR A PHOTOCONDUCTOR DRUM

[75] Inventor: Mitsutoshi Takemoto, Yao, Japan

[73] Assignee: Mita Industrial Co., Ltd., Osaka, Japan

[21] Appl. No.: 413,262

[22] Filed: Sep. 27, 1989

[30] Foreign Application Priority Data

Sep. 29, 1988 [JP] Japan ..... 63-244891

[51] Int. Cl.[5] ..... G03G 15/02

[52] U.S. Cl. ..... 355/219; 355/218; 362/382

[58] Field of Search ..... 355/218, 219, 67; 362/217, 225, 220, 800, 382

[56] References Cited

U.S. PATENT DOCUMENTS 4,059,345 11/1977 Kawamura et al. ..... 355/1 X
4,262,075 4/1981 Noda et al. ..... 355/218 X
4,528,573 7/1985 Behrens et al. ..... 355/1 X
4,602,262 7/1986 Milligan et al. ..... 355/229 X
4,715,682 12/1987 Koek et al. ..... 355/1 X
4,728,981 3/1988 Koek et al. ..... 355/1
4,801,975 1/1989 Kano et al. ..... 355/218

FOREIGN PATENT DOCUMENTS 0103672 5/1987 Japan ..... 355/218

*Primary Examiner*—A. T. Grimley
*Assistant Examiner*—J. E. Barlow, Jr.
*Attorney, Agent, or Firm*—Koda & Androlia

[57] ABSTRACT

A mounting for a discharge device which removes the voltage potential from a photoconductive drum. The discharge device is preferably a lengthy lamp block installed in parallel with the photoconductive drum in the direction of the drum's axis. The lamp block is mounted in a fashion which allows it to be inserted in place or removed from the mounting. Further, it is mounted to be elastically expandable in a radial and a longitudinal direction responding to the effects of thermal expansion. The lamp block is held in place between an elastic member and a tab or positioning portion.

1 Claim, 4 Drawing Sheets

DISCHARGING DEVICE FOR A PHOTOCONDUCTOR DRUM

BACKGROUND OF THE INVENTION

1. Field of the Invention

The present invention relates to a discharging device, or particularly to a discharging device for the photoconductor drum to erase the latent image remaining on the surface of the photoconductor drum by means of the discharge lamps.

2. Description of the Prior Art

An example of the conventional discharging device for the photoconductor drum is shown in FIGS. 3 and FIG. 4. For a discharging device 51 shown in FIG. 4, both longitudinal direction ends of a discharge lamp block 2 with several discharge lamps are attached to a mounting plate 53 with the screw 54. In building the discharging device 51 in a copying machine, the mounting plate 53 should be attached to a cleaning unit 30 so as to make the discharge lamp block 2 position between a main charger 20 and the cleaning unit 30 as shown in FIG. 3.

After removal of the toner remaining on a photoconductor drum 10 with the cleaning unit 30, the latent image remaining on the surface of the photoconductor drum 10 is erased by radiation of the light in a field (b) corresponding to the discharge lamp block 2. Successively the surface of the photoconductor drum 10 is charged uniformly by means of the corona discharge in a field (a) corresponding to the main charger 20.

For the discharging device 51 mentioned above, the temperature of the discharge lamp block 2 must become high to some degree owing to the exothermic reaction from the discharge lamps or from another heat source, for instance, a fusing roller possessed in the copying machine. So the thermal expansion of the discharge lamp block 2 in the longitudinal direction particularly becomes distinguished.

The discharge lamp block 2, however, could not expand at both ends in the longitudinal direction by some increasing length on account of its thermal expansion because it is attached at the foregoing both ends with the screws hitherto. For that reason, all over the discharge lamp block 2 is forced to flex. As the result, the distance between the photoconductor drum 10 and the discharge lamps differs by part in the longitudinal direction. The difference of the distance will be a cause of the potential nonuniformity on the surface of the photoconductor drum 10. The industrial-use wide copying machine especially shows the foregoing tendency greatly. Therefore the solution for such problems has been looked forward to.

Furthermore in the conventional discharging device 51 shown in FIG. 3, the field (a) and the field (b) of the photoconductor drum 10 according to the main charger 20 and the discharge lamp block 2 overlap sectionally, and are not partitioned distinctly as a straight boundary. Accordingly such an overlap of both fields (a), (b) will be another cause of the potentional nonuniformity.

Moreover the discharge lamp block 2 is deformed in the radial of the photoconductor drum 10 by the thermal strain in itself comprising as a complex of the plastic moldings and the electronic parts such as LED and so forth. So the above-said deformation will be still another cause of the potential nonuniformity.

SUMMARY OF THE INVENTION

The present invention was made to solve the conventional problems as mentioned above.

It is an object of this invention to provide a discharging device for a photoconductor drum preventing from an appearance of the potential nonuniformity owing to the thermal expansion of the discharge lamp block.

That is to say, the first invention will provide a discharging device for a photoconductor drum, wherein a lengthy discharge lamp block is installed in parallel with a circumferential surface of the photoconductor drum, characterized by comprising the discharge lamp block attached slidablly in its longitudinal direction.

On the function of a discharging device of a photoconductor drum related to the first invention, for example, the discharge lamp block can expand at both ends in the longitudinal direction by some increasing length on account of its thermal expansion because of its slidability in the direction. Therefore the flexing of the discharge lamp block can be prevented. Consequently the potential nonuniformity on the surface of the photoconductor drum will not appear due to the changeless distance between the photoconductor drum and the discharge lamps.

Next it is another object of this invention to provide a discharging device for a photoconductor drum preventing from an appearance of the potential nonuniformity owing to the indistinct partition between both fields said above and to the thermal deformation of the discharge lamp block in itself.

Accordingly the second embodiment of the invention will provide a discharging device for a photoconductor drum, wherein a lengthy discharge lamp block is installed in parallel with a circumferential surface of the photoconductor drum and in the next to a main charger, characterized by comprising a partition plate provided at the position between the discharge lamp block and the main charger with expansion toward the photoconductor drum to partition the circumferential surface into a field corresponding to the main charger and a field corresponding to the discharge lamp block, and a positioning portion provided on the partition plate to prevent from a change of the distance between the photoconductor drum and the discharge lamp block.

For a discharging device of a photoconductor drum related to the second invention, for example, the field corresponding to the discharge lamp block can be divided off from the field corresponding to the main charger distinctly with a straight boundary, namely, a rectilinear partition plate.

And the positional change of the discharge lamp block by the thermal deformation in itself is controlled with a part of the body of the partition plate provided a positioning portion. So the distance between the discharge lamp block and the photoconductor drum can be kept fixedly without increasing the number of parts. The potential nonuniformity due to the overlapping of both fields stated above and to the thermal deformation of the discharge lamp block in itself will not appear as a result.

While the specification concludes with claims particularly pointing out and distinctly claiming the subject matter of the invention, it is believed the invention will be better understood from the following description taken in connection with the accompanying drawing in which:

DETAILED DESCRIPTION OF THE PREFERRED EMBODIMENTS

Figure 1:
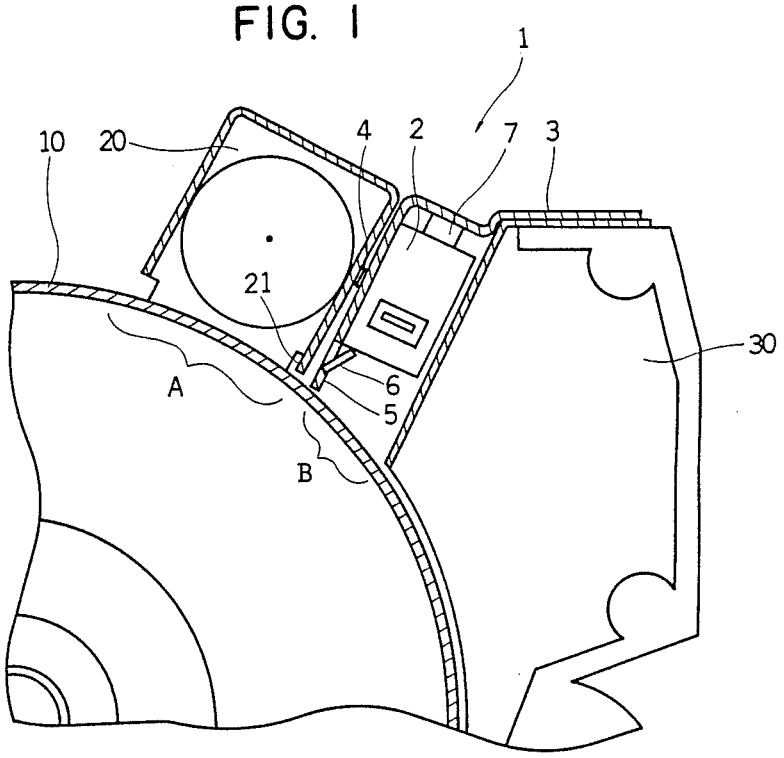
FIG. 1 is a fragmentary sectional view of a principal part of a copying machine built in a discharging device for a photoconductor drum according to an embodiment of the present invention.
Figure 2:
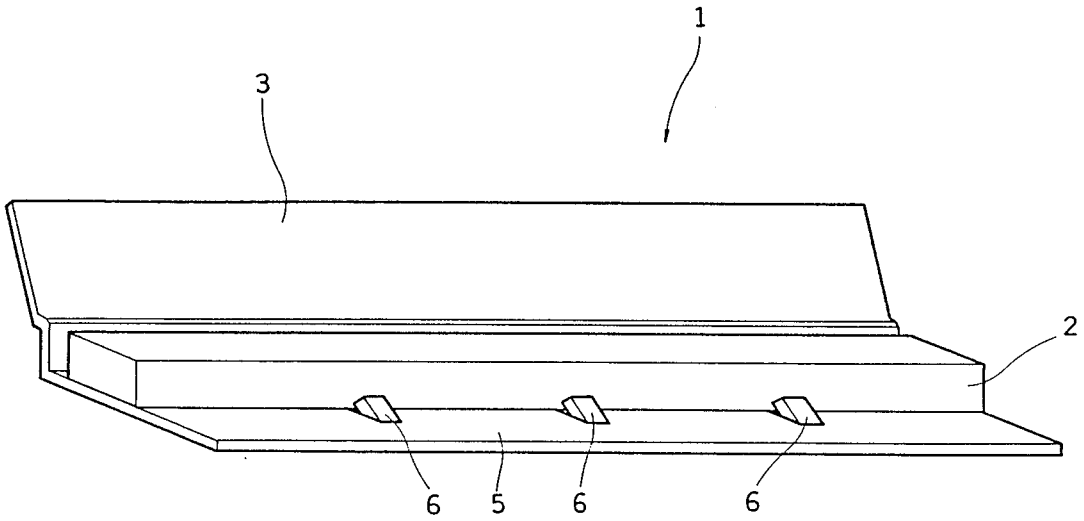
FIG. 2 is a perspective side view of the discharging device for the photoconductor drum.
Figure 3:
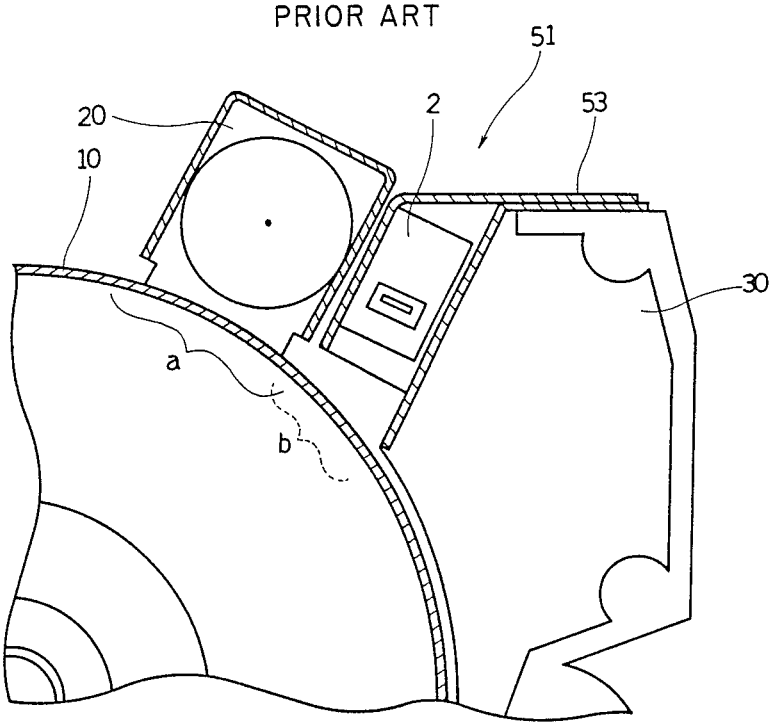
FIG. 3 PRIOR ART
FIG. 3 is a fragmentary sectional view of a principal part of a copying machine built in a conventional discharging device for a photoconductor drum.
Figure 4:
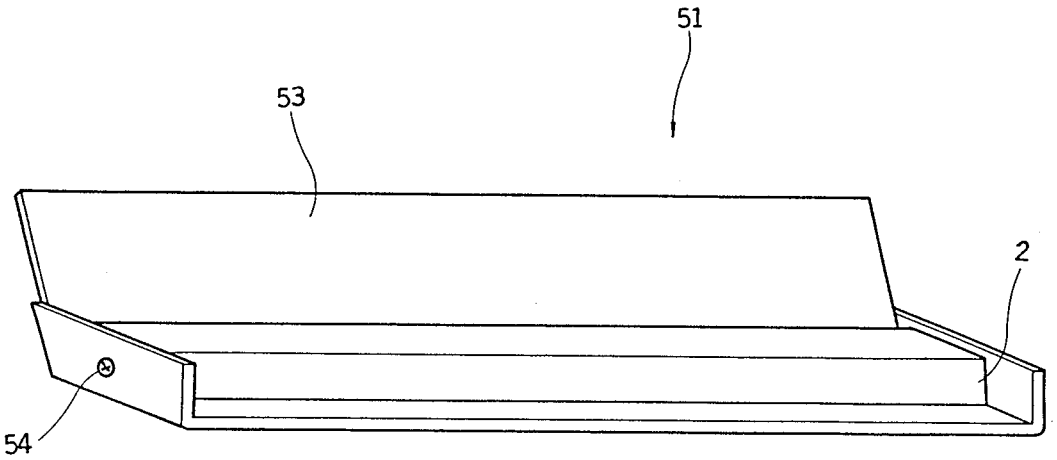
FIG. 4 PRIOR ART
FIG. 4 is a perspective side view of the conventional discharging device for the photoconductor drum.

A discharging device 1 for a photoconductor drum 10 as a preferred embodiment of the present invention is shown in FIG. 1 and FIG. 2.

In the discharging device 1 a shown in the foregoing figures respectively, a discharge lamp block 2 made of resin and included several discharge lamps in is attached with the screw 4 to a mounting plate 3 made of metal. The attachment manner with the screw 4 is made with the characteristics that the screw 4 is directed its axis to the orthogonal direction against the longitudinal direction of the discharging lamp block 2 and that the screw insert hole of the mounting plate 3 is formed somewhat large especially in the longitudinal direction as the discharge lamp block 2 can slide moderately in the direction.

When the discharge lamp block 2 is built in the copying machine, the edge of the mounting plate 3 facing to the photoconductor drum 10, functioning as a partition plate 5 dividing into a field (A) according to a main charger 20 and a field (B) according to the discharge lamp block 2, is provided lengthways near the surface of the photoconductor drum 10. That is to say, the overlapping of both fields (A), (B) will be prevented by the partition plate 5. Furthermore the edge 21 of the sealed case enclosing the main charger 20 next to the discharging device 1 is provided lengthways near the surface of the photoconductor drum 10 for the above-said purpose.

The protrusions 6 are formed at the appointed positions of the partition plate 5 by punching and bending upward. The protrusions 6 control the distance between the discharge lamp block 2 and the photoconductor drum 10. And a spring plate 7 energized the discharge lamp block 2 toward the protrusions 6.

According to the discharging device 1 composed as stated above, for example, in case that the discharge lamp block 2 and the mounting plate 3 expand on account of a rise of its temperature, the difference of the increasing length of the both owing to their thermal expansion is offset by their relative slide respectively. Besides the thermal flexing deformation in itself as changing the distance to the discharge lamp block 2 is controlled by the protrusion 6 without control of the thermal expansion of the discharge lamp block 2 in its longitudinal direction.

For the reason, the distance between the photoconductor drum 10 and the discharge lamps is maintained uniformly in all over the longitudinal direction. So the potential nonuniformity on the surface of the photoconductor drum 10 will not appear.

And the potential nonuniformity will not appear also due to the partition of the field (B) according to the discharge lamp block 2 from the field (A) according to the main charger 20 with the partition panel 5 possessing the straight edge.

Owing to the reason as mentioned above, the change of the distance between the photoconductor drum and the discharge lamps is prevented, and the field influenced by the main charger and by the discharge lamps is partitioned straightly in a distinctive separation. Therefore the potential nonuniformity will be prevent due to the bending of the part of the discharge lamp block 2 overlapping of both fields (A), (B). As a result, the capacity, of the copying machine, i.e., the copying quality can be improved.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

I claim:

1. A discharging device for photoconductor drum, wherein a lengthy discharge lamp block is installed slidably in a longtitudinal direction of said photoconductor drum on a mounting plate installed in parallel with a circumferential surface of said photoconductor drum, characterized by comprising:

a positioning portion provided on an edge portion expanded toward said photoconductor of said mounting plate to prevent changes in the distance between said photoconductor drum and said discharge lamp block; and an elastic member provided between an upper face of said discharge lamp block and a lower face of said mounting plate to hold said discharge lamp block slidably in said longitudinal direction of said photoconductor drum and elastically in a radial direction of said photoconductor drum between said elastic member and said positioning portion.

* * * * *